United States Patent [19]

Izumi

[11] 4,020,637

[45] May 3, 1977

[54] VEHICLE STEAM ENGINE USING ON-OFF VALVES FOR CONTROLLING STEAM TEMPERATURE AND PRESSURE

[75] Inventor: Hisashi Izumi, Fujisawa, Japan

[73] Assignee: Nissan Motor Co., Ltd., Yokohama, Japan

[22] Filed: Jan. 26, 1976

[21] Appl. No.: 652,641

[30] Foreign Application Priority Data

Jan. 27, 1975 Japan ..... 50-11102

[52] U.S. Cl. ..... 60/665; 60/667; 122/448 R

[51] Int. Cl.[2] ..... F01K 13/02

[58] Field of Search ..... 60/660–667; 180/54 R, 66 R, 66 C, 67; 415/13, 17, 30; 122/448 R, 448 S

[56] References Cited

UNITED STATES PATENTS

| | | | |
|---|---|---|---|
| 1,287,915 | 12/1918 | Doble | 60/660 UX |
| 3,125,073 | 3/1964 | Profos | 60/667 X |
| 3,906,731 | 9/1975 | Carlson | 60/665 |

*Primary Examiner*—Allen M. Ostrager

[57] ABSTRACT

In a vehicle steam engine having a steam generating unit, a condenser, fluid pumps for supplying the condensed liquid and fuel to the steam generating unit, a plurality of bypass passages are connected between the input and output sides of each pump. An electromagnetic on-off valve is provided in each bypass passage. Sensors are connected to the steam generating unit to detect variations in temperature and pressure of the steam to provide corresponding electrical signals. Each of the sensed signals is compared with different critical levels to produce output signals at one of two discrete levels to open the bypass passages in stages to thereby regulate the flow rate of the fluid to the steam generating unit.

4 Claims, 1 Drawing Figure

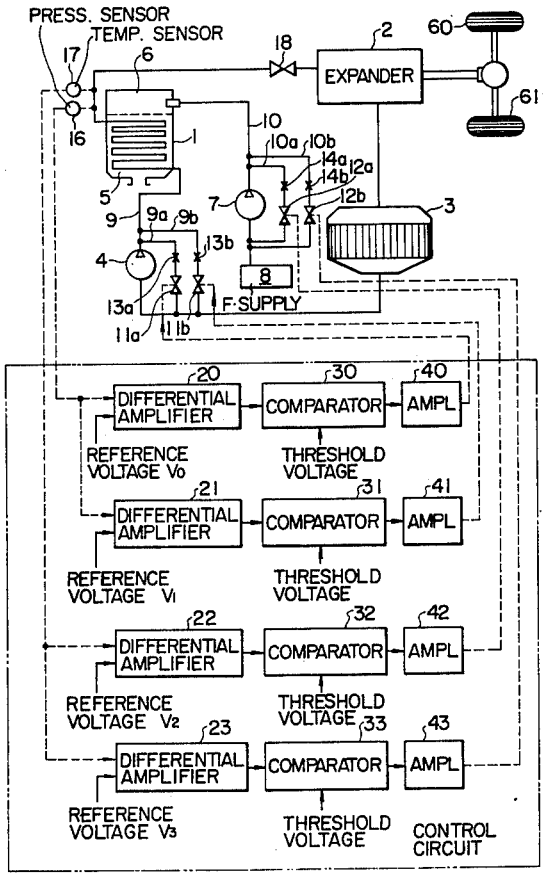

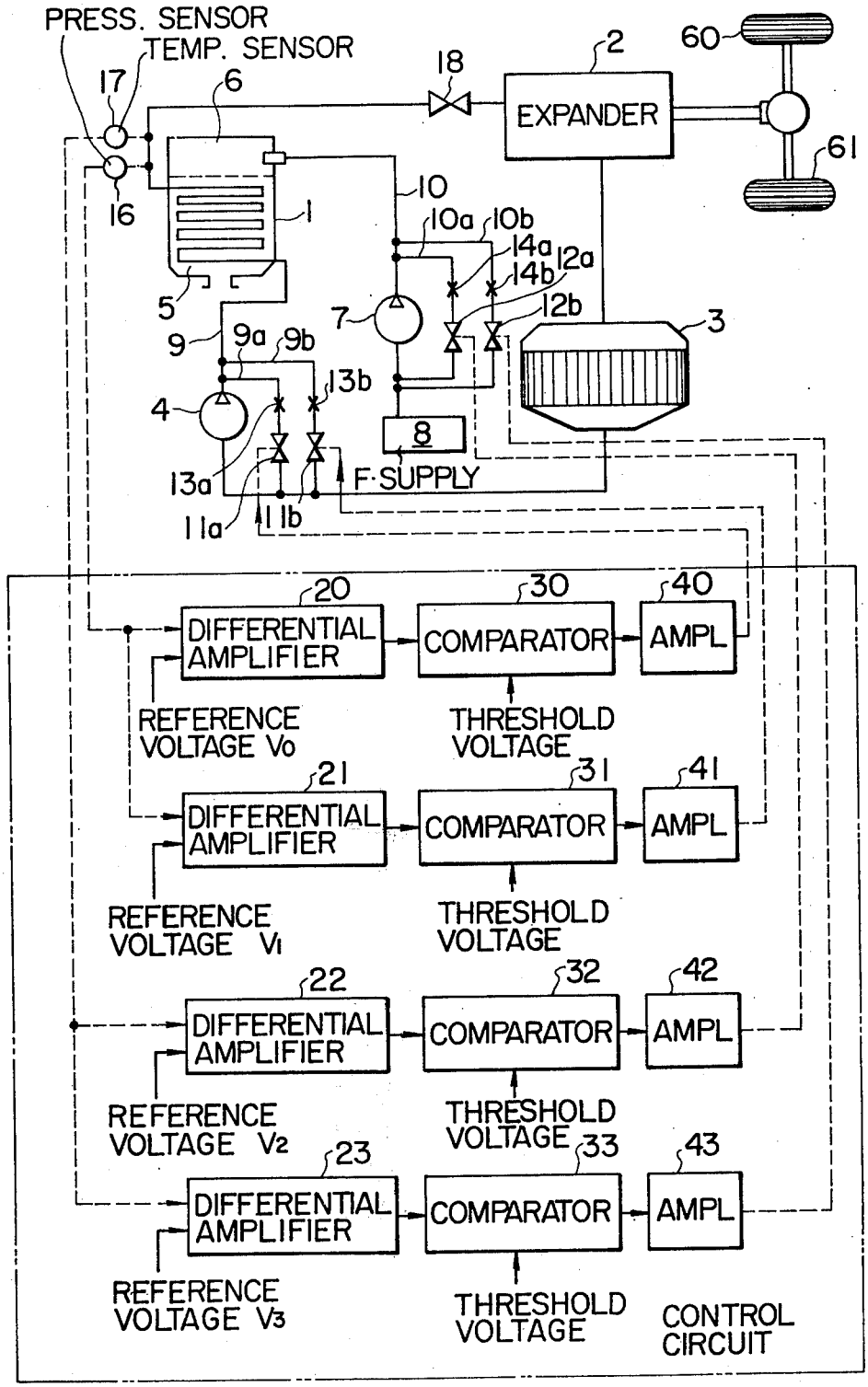
PRESS. SENSOR
TEMP. SENSOR
17
6
18
2
EXPANDER
60
61
16
1
10
10a
10b
14a
14b
12a
12b
5
7
3
9
9a
9b
13b
4
8
F·SUPPLY
13a
11a
11b
20
DIFFERENTIAL AMPLIFIER
30
COMPARATOR
40
AMPL
REFERENCE VOLTAGE V0
THRESHOLD VOLTAGE
21
DIFFERENTIAL AMPLIFIER
31
COMPARATOR
41
AMPL
REFERENCE VOLTAGE V1
THRESHOLD VOLTAGE
22
DIFFERENTIAL AMPLIFIER
32
COMPARATOR
42
AMPL
REFERENCE VOLTAGE V2
THRESHOLD VOLTAGE
23
DIFFERENTIAL AMPLIFIER
33
COMPARATOR
43
AMPL
REFERENCE VOLTAGE V3
THRESHOLD VOLTAGE
CONTROL CIRCUIT

VEHICLE STEAM ENGINE USING ON-OFF VALVES FOR CONTROLLING STEAM TEMPERATURE AND PRESSURE

The present invention relates to steam engines, and in particular to a closed-loop controlled steam generating unit in which the generated steam is maintained within controlled ranges of pressure and temperature to compensate for disturbances to the engine.

The steam engine is considered as one of the rivivals for the future vehicle prime mover because of its favorable operating principle for the rigorous engine emission requirements. In the steam engine, whether it may be of the reciprocating type or the turbine type, it is desirable to control the pressure and temperature of the steam within a prescribed range to increase the available power output and the durability of the engine, as well as from the standpoint of system design.

The use of analog displacement type solenoid valves may be effective to control such engine parameters. However, the circuit required to control such valves would become unduly complicated with the consequential increase in the total cost.

The primary object of the present invention is to provide a closed-loop controlled steam generating unit in which the amount of fuel and water supplied to the steam generating unit of the engine is regulated in response to variations in temperature and pressure of the generated steam by means of electromagnetic on-off control valves.

Another object of the invention is to provide a closed-loop controlled steam generating unit in which the pressure control is effected by regulating the flow of the water supplied to the steam generating unit, while the temperature control is effected by regulating the flow of fuel supplied to the steam generating unit.

The invention will be described by way of example in conjunction with the single accompanying drawing which illustrates the steam engine embodying the present invention in schematic form.

Referring now to the drawing, reference numeral 1 designates a steam generating unit having a steam generating section 5 and a fuel combustion chamber 6. Numeral 2 indicates an expander or turbine which is connected through a throttle valve 18 to the steam outlet of the steam generating unit 1. A condenser 3 is connected to the turbine 2 in conventional manner to receive the steam exhausted from the turbine and delivers condensed water through the steam inlet pipe 9 to the steam generating unit 1 by way of a pump 4. Also connected to the unit 1 is a fuel container 8 through the fuel inlet pipe 10 by way of a pump 7 to sustain fuel combustion in the chamber 6 of unit 1.

Bypass fluid circuits **9*a* and 9*b* are connected between the pump 4. Electromagnetic on-off control valves 11*a* and 11*b* are connected in the passages 9*a* and 9*b*, respectively. The fluid circuits 9*a* and 9*b* are provided with restrictions 13*a* and 13*b*, respectively, or different cross-sectional dimensions. The electromagnetic valves 11*a* and 11*b* are respectively controlled by signals from a control circuit 5** which will be described later.

Another set of bypass fluid circuits **10*a* and 10*b* is connected between the input and output sides of the pump 7, as shown. The fluid passages 10*a* and 10*b* are provided with restrictions 14*a* and 14*b* of different cross sections. The electromagnetic on-off valves 12*a* and 12*b* are also controlled by signals from the control circuit 15.**

A pressure sensor 16 which may comprise a metallic sensing element such as a flexible curved tube (bourdon tube) or a flexible diaphragm which deforms under fluid pressure and a rheostat which develops an electrical signal of which the amplitude is variable in proportion to the sensed fluid pressure at the outlet of the steam generating unit. Also provided at the steam outlet is a temperature sensor 17 which may comprise a temperature sensing element such a bimetal and rheostat to develop an electrical signal of which the magnitude is variable in proportion to the sensed fluid temperature.

The control circuit 15 comprises a number of series circuits, each including a differential amplifier, a comparator and a power amplifier connected in series. The output of the pressure sensor 16 is connected to one input of the differential amplifiers 20 and 21 whose outputs are connected respectively to the inputs of the comparators 30 and 31, the outputs of which being amplified by the respective amplifiers 40 and 41. Differential amplifier 20 has its other input terminal coupled to a reference voltage $V_o$ and provides an output which is a difference between the sensed voltge representing the fluid pressure and the reference voltage $V_o$. This difference voltage is compared with a threshold voltage by the comparator 30 and as a result of which a signal is produced when the threshold voltage is attained. This signal is amplified by the amplifier 40 to a level required to operate an electromagnetic valve. The amplified signal is coupled to energize the control valve **11*a* to open the bypass circuit 9*a*.**

On the other hand, differential amplifier 21 provides an output which is a difference between the input voltage and a reference voltage $V_1$ greater than $V_o$. The comparator 31 compares this difference voltage with a threshold voltage of the same value as that applied to the comparator 30, so that comparator 31 provides an output when the sensed pressure indicating voltage continues to increase to a voltage above the first setting voltage $V_o$ to operate the valve **11*b* to open the bypass 9*b* in parallel with the opened bypass passage 9*a*.**

Differential amplifiers 22 and 23 have one of their inputs connected in common to the temperature sensor 17 and have their other inputs connected to respective voltage sources of potentials $V_2$ and $V_3$. The sensed temperature representative signal is compared with the reference voltages $V_2$ and $V_3$ in stages and upon the input exceeding the reference voltage, signals are delivered to comparators 32 and 33 representing the difference between the compared voltages. The outputs from the differential amplifiers 22 and 23 thus appear in sequence as the input sensed voltage continues to increase. The comparators 32 and 33 compare the difference voltages with a predetermined threshold voltage of the same value to produce a signal indicating that the sensed voltage is above the predetermined setting values, the signal being amplified by amplifiers 42 and 43 to operate the valve **12*a* and 12*b*,** respectively.

In operation, the steam obtained from the steam generating unit 1 is transmitted through the throttle valve 18 to the expander or turbine 2 where the working agent expands to do some mechanical work which is used to drive vehicle wheels 60 and 61 through a well known gearing mechanism. After expansion, the working agent is conducted to the condenser 3 of the well known type where it condenses to water. While the working agent is doing work, a portion of the output power from the turbine 2 is used to operate the pumps 4 and 7 to continue to supply water and fuel to the steam generating unit 1. Therefore, the amount of supplied water and fuel is proportional to the amount of mechanical power delivered to the load. Therefore, if the load remains at a constant level, the amount of power available is held at a constant value.

If, under this condition, disturbance occurs to the system as would occur when load varies, changes in pressure and temperature of the steam would result. Such changes are detected by the sensors 16 and 17. The sensed signals are applied to the respective differential amplifiers 20 to 23 and processed by the associated series circuits as described above to activate the respective bypass circuits 9*a*, 9*b*, 10*a* and 10*b*. When these bypass passages are open, the pumps 4 and 7 are shunted so that portions of the pumped flow are recirculated through the bypass circuits to thereby reduce the total amount of fluid supplied to the steam generating unit 1.

In order to control the temperature and pressure of the system, both of these system parameters are initially set at a value slightly above a predetermined setting value of the system for which the flow rate controlled by the pumps 4 and 7 is at a minimum. Under these conditions, the temperature and pressure of the steam would not drop below the system's setting value when all of the control valves are closed so that control is effected in a direction to decrease the fluid supply to the steam generating unit 1 by providing bypass passages in stages in proportion to the degree of increase in the controlled parameters.

When the steam pressure increases to a level above the first preset value determined by the differential amplifier 20 and comparator 30, the bypass passage 9*a* is open to reduce the flow rate of water by an amount determined by the restriction 13*a* which is smaller in cross section than the cross section of restriction 13*b*. The reduction in the water flow rate causes a reduction in pressure in the steam pipe within the steam generating unit 1. If the steam pressure still continues to rise, the second valve 11*b* will be open to further reduce the flow rate to a minimum.

In the same way, temperature control is accomplished by opening the passages 10*a* and 10*b* to reduce the flow rate of fuel supplied to the steam generating unit 1 in stages when an increase in the steam temperature is detected by sensor 17.

What is claimed is:

1. A vehicle steam engine comprising, a steam generating unit; means for converting the generated steam into useful work; a condenser connected to the converting means to condense the steam to the liquid state; a first pump connected to the condenser to supply the liquid to the steam generating unit; a second pump connected to a source of fuel supply to supply the fuel to the steam generating unit to sustain combustion therein; first means for sensing the pressure of the steam and producing a first signal representative of the sensed pressure; second means for sensing the temperature of said steam and producing a second signal representative of the sensed temperature; first on-off fluid control means connected to the first pump to control the flow rate of the liquid; second on-off fluid control means connected to the second pump to control the flow rate of the fuel; and a control circuit responsive to the first and second signals to produce third and fourth signals respectively when each of said first and second signals differs in magnitude from a preset value, said third and fourth signals being connected to operate the first and second on-off fluid control means, respectively to provide changes in the flow rate of said liquid and fuel.

2. A vehicle steam engine as claimed in claim 1, wherein said first and second on-off control means are connected in parallel with the first and second pumps respectively to provide bypass passages.

3. A vehicle steam engine as claimed in claim 2, wherein each of said first and second on-off control means comprises a plurality of electromagnetic on-off valves and a plurality of conduits having restrictions of different cross sections, said conduits connected across the input and output sides of said pumps, said on-off valves being interposed in said conduits and arranged to be energized to open the conduits in response to the third and fourth signals.

4. A vehicle steam engine as claimed in claim 3, wherein said control circuit comprises a plurality of comparing means arranged to compare each of the first and second signals with different critical levels to produce a plurality of electrical pulses at one of two discrete levels depending upon whether each of the first and second signals is above or below the critical levels, said pulses being connected to the on-off valves.

* * * * *